US007151450B2

(12) United States Patent
Beggs et al.

(10) Patent No.: US 7,151,450 B2
(45) **Date of Patent: *Dec. 19, 2006**

(54) DOOR WITH A SAFETY ANTENNA

(75) Inventors: Ryan P. Beggs, Dubuque, IA (US); Lucas I. Paruch, Dubuque, IA (US); James C. Boerger, Franksville, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/405,794

(22) Filed: Apr. 18, 2006

(65) Prior Publication Data

US 2006/0197663 A1 Sep. 7, 2006

Related U.S. Application Data

(63) Continuation of application No. 10/600,253, filed on Jun. 20, 2003, now Pat. No. 7,034,682.

(51) Int. Cl.

| | |
|---|---|
| ***G08B 13/08*** | (2006.01) |
| ***G08B 13/24*** | (2006.01) |
| ***E05F 15/02*** | (2006.01) |
| ***E05F 15/10*** | (2006.01) |
| ***E05F 15/20*** | (2006.01) |
| ***A47G 5/02*** | (2006.01) |
| ***A47H 1/00*** | (2006.01) |
| ***E06B 9/56*** | (2006.01) |

(52) U.S. Cl. ..... 340/545.1; 340/545.2; 340/545.3; 340/545.7; 340/551; 49/25; 49/26; 49/27; 49/28; 160/1; 160/310

(58) Field of Classification Search ..... 340/545.1, 340/545.2, 545.3, 545.7, 551; 49/25, 26, 49/27, 28; 160/1, 310
See application file for complete search history.

(56) References Cited

U.S. PATENT DOCUMENTS 3,303,303 A 2/1967 Miller (Continued)

FOREIGN PATENT DOCUMENTS

CA 2049112 5/2002

(Continued)

OTHER PUBLICATIONS

Smart Gate, Inc; *Non-contact Safety for Gates and Doors,* circa Jan. 1, 2005, 10 Pages.

(Continued)

*Primary Examiner*—Daniel Wu
*Assistant Examiner*—Lam Pham
(74) *Attorney, Agent, or Firm*—Hanley, Flight & Zimmerman, LLC

(57) ABSTRACT

A door system includes an antenna-based proximity sensor with a releasable electrical connector that enables the sensor to function with a breakaway feature of the door. The sensor includes a signal generator and a door-mounted antenna for sensing a body or an obstruction near the door. The signal generator (or oscillator) can be installed at various locations between a power source and the antenna. In some cases, the wiring between the antenna and the power source includes a rotatable feature to accommodate the rotation of a drum that carries a wrap-up, pliable door panel. The rotatable feature may be a rotatable electrical connector, or it may be a wire having sufficient length and flexibility to twist about itself within the hollow interior of the drum.

2 Claims, 11 Drawing Sheets

U.S. PATENT DOCUMENTS 3,346,856 A 10/1967 Doble
3,352,059 A 11/1967 Metz
3,670,164 A 6/1972 Hardy et al.
3,855,733 A 12/1974 Miller
3,989,932 A 11/1976 Koerner
4,051,336 A 9/1977 Miller
4,075,563 A 2/1978 Battle
4,103,252 A 7/1978 Bobick
4,143,367 A 3/1979 Scheslag
4,169,260 A 9/1979 Bayer
4,240,528 A 12/1980 Kraus
4,342,354 A 8/1982 Leivenzon et al.
4,345,167 A 8/1982 Calvin
4,501,963 A 2/1985 Perisic
4,519,474 A 5/1985 Iseli et al.
4,551,711 A 11/1985 Akiyama et al.
4,565,029 A 1/1986 Kornbrekke et al.
4,611,197 A 9/1986 Sansky
4,612,442 A 9/1986 Toshimichi
4,623,032 A 11/1986 Kemmer
4,652,864 A 3/1987 Calvin
4,706,227 A 11/1987 Duvall et al.
RE32,828 E 1/1989 Mudge
4,833,450 A 5/1989 Buccola
4,849,635 A 7/1989 Sugimoto
4,849,735 A 7/1989 Kirtley et al.
4,853,531 A 8/1989 Reje
4,857,912 A 8/1989 Everett, Jr. et al.
4,944,116 A 7/1990 Mewald
4,967,083 A 10/1990 Kornbrekke et al.
5,001,557 A 3/1991 Regli
5,026,990 A 6/1991 Marman et al.
5,027,552 A 7/1991 Miller et al.
5,034,722 A 7/1991 Premack
5,055,685 A 10/1991 Sugimoto et al.
RE33,824 E 2/1992 Johnson
5,142,152 A 8/1992 Boluncaner
5,142,822 A 9/1992 Beckerman
5,149,921 A 9/1992 Picado
5,198,974 A 3/1993 Orsat
5,216,246 A 6/1993 Weldman et al.
5,216,410 A 6/1993 Pildner et al.
5,228,492 A 7/1993 Jou
5,229,617 A 7/1993 Saitoh et al.
5,314,037 A 5/1994 Shaw et al.
RE034,665 E 7/1994 Strand
5,334,972 A 8/1994 Sugimoto et al.
5,335,749 A 8/1994 Taguchi et al.
5,337,039 A 8/1994 Simon
5,357,183 A 10/1994 Lin
5,384,982 A 1/1995 Galperin
5,410,149 A 4/1995 Winston, Jr. et al.
5,420,430 A 5/1995 Trett
5,461,231 A 10/1995 Sugimoto et al.
5,468,960 A 11/1995 Sugimoto et al.
5,489,892 A 2/1996 Imuro et al.
5,541,585 A 7/1996 Duhame et al.
5,584,145 A 12/1996 Teich
5,592,777 A 1/1997 Petri et al.
5,596,840 A 1/1997 Teich
5,644,111 A 7/1997 Cerny et al.
5,652,577 A 7/1997 Frasier
5,656,995 A 8/1997 Peters
5,689,235 A 11/1997 Sugimoto et al.
5,703,368 A 12/1997 Tomooka et al.
5,706,875 A 1/1998 Simon
5,712,477 A 1/1998 Delaney, III et al.
5,713,621 A 2/1998 Krenkel et al.
5,728,984 A 3/1998 Miller
5,739,523 A 4/1998 Tsutsumi et al.
5,743,317 A * 4/1998 Beringer et al. ..... 160/10
5,789,739 A 8/1998 Schwarz
5,793,357 A 8/1998 Ivey et al.
5,812,058 A 9/1998 Sugimoto et al.
5,828,302 A 10/1998 Tsutsumi et al.
5,832,665 A 11/1998 Miller et al.
5,839,227 A 11/1998 Gardner
5,887,385 A * 3/1999 Horner et al. ..... 49/26
5,921,026 A 7/1999 Miller
5,957,187 A 9/1999 Gruben et al.
5,964,058 A 10/1999 Ricardson
5,986,265 A 11/1999 Kim et al.
5,996,281 A 12/1999 Takano et al.
6,002,333 A 12/1999 Hickey
6,080,981 A 6/2000 Payne
6,172,315 B1 1/2001 Miller et al.
6,218,940 B1 4/2001 Reje et al.
6,243,006 B1 6/2001 Reje et al.
6,265,970 B1 7/2001 Whitehead
6,286,257 B1 9/2001 Gregoriou et al.
6,326,899 B1 12/2001 Chisnall
6,342,706 B1 1/2002 Takeda
6,347,486 B1 2/2002 Badillet
6,348,685 B1 2/2002 Givet
6,348,863 B1 2/2002 Krubner et al.
6,414,314 B1 7/2002 Ikeda
6,427,382 B1 8/2002 Gregoriou et al.
6,502,619 B1 1/2003 Krauetler
6,571,512 B1 6/2003 Miller et al.
6,598,648 B1 7/2003 Schulte
6,600,113 B1 7/2003 Miller
6,612,357 B1 9/2003 Beringer et al.
6,651,385 B1 11/2003 Miller et al.
6,678,999 B1 1/2004 Zengguang et al.
6,683,296 B1 1/2004 Miller et al.
6,730,902 B1 5/2004 Imai et al.
6,750,441 B1 6/2004 Imahori et al.
6,779,302 B1 8/2004 Harrison et al.
6,860,065 B1 3/2005 Griffin et al.
6,964,289 B1 * 11/2005 Schulte ..... 160/1
2002/0041231 A1 4/2002 Drinkard
2002/0046494 A1 4/2002 Miller et al.
2003/0047670 A1 3/2003 Miller et al.
2003/0192252 A1 10/2003 Harrison et al.
2004/0088922 A1 5/2004 Miller et al.
2004/0187406 A1 9/2004 Gallagher et al.
2004/0194386 A1 10/2004 Albiero

FOREIGN PATENT DOCUMENTS

DE 3031363 12/1981
DE 29714616 1/1998
DE 19928211 12/2000
DE 10203145 4/2003
EP 0236755 9/1987
EP 0699619 7/1995
EP 0671532 9/1995
EP 0678649 10/1995
EP 0765990 9/1996
EP 0624857 9/1998
EP 0902158 A2 3/1999
EP 0902158 B1 3/1999
EP 0914536 5/1999
EP 1233138 8/2002
EP 1253276 10/2002
EP 0843070 3/2003
EP 0902157 A2 3/2003
EP 0902157 B1 3/2003
GB 1578493 3/1978
GB 2343710 3/1999
GB 2354068 8/2000
GB 2391936 8/2002
JP 05001991 1/1993
JP 07038622 9/1995

| | | |
|---|---|---|
| JP | 2002138781 | 11/2000 |
| JP | 2001147276 | 5/2001 |
| JP | 2001317270 | 11/2001 |
| JP | 2002106277 | 4/2002 |
| JP | 2002121983 | 4/2002 |
| JP | 2002285755 | 10/2002 |
| JP | 2003265639 | 9/2003 |
| JP | 2004068515 | 3/2004 |
| WO | 1998003757 | 1/1998 |
| WO | 2000053880 | 9/2000 |
| WO | 2002019698 | 3/2002 |
| WO | 2002029747 | 4/2002 |
| WO | 2002029748 | 4/2002 |
| WO | 2003027424 | 4/2003 |
| WO | 2003087513 | 4/2003 |
| WO | 2003085230 | 10/2003 |
| WO | 2003100941 | 12/2003 |

OTHER PUBLICATIONS

Overhead Door Corporation, *Jetroll, Overhead Door JETROLL,* Form A-988, Oct. 1995, 14 Pages.

Optex, Inc.; Product Brochure for VX-40/40A Multi Stablized Outdoor Detector; Received by applicant prior to Oct. 17, 2002, 4 Pages.

* cited by examiner

DOOR WITH A SAFETY ANTENNA

RELATED APPLICATIONS

This application is a continuation claiming priority from U.S. application Ser. No. 10/600,253, filed Jun. 20, 2003, now U.S. Pat. No. 7,034,682 and incorporated by reference in its entirety.

BACKGROUND OF THE INVENTION

1. Field of the Invention

The subject invention generally pertains to a system for detecting the presence of a body near a door and more specifically to a system that includes an antenna for sensing the body.

2. Description of Related Art

There are a wide variety of available devices for detecting the presence of a body, such as a person or object, near a doorway. Such detection devices, known as proximity sensors, photoelectric eyes, motion detectors, etc., operate under various principles including, ultrasonics; active and passive detection of infrared radiation; detection of electromagnetic radiation (including sensing radio waves or sensing changes in capacitance or impedance); detecting a Doppler shift in microwaves; and lasers. In response to sensing a nearby body, the detector may simply trigger a light or an alarm, or the device may affect the operation of a door.

Some proximity sensors comprise an antenna that creates an electromagnetic field along the leading edge of a vertically operating door. When a nearby body disturbs the field, the sensor may trigger a controller to stop or reverse the closing action of the door. If the antenna moves vertically with the door and the controller and power supply are stationary, then wiring between the antenna and the controller must allow for the movement of the antenna. This can be accomplished by using a flexible coiled cable between the controller and the antenna. A coiled cable, however, has its limitations.

Many doors, for instance, have a breakaway feature that allows a door to temporarily break away from its vertical guide tracks should a collision occur between the door and a vehicle or other obstruction. During the collision, the breakaway feature allows the door to yield without permanently damaging the door or its guide tracks. After the collision, the door is readily restored to its normal operation. Although a coiled cable may have sufficient flexibility to allow a door to open and close, such a cable may get entangled with the door, track or vehicle during a collision.

Thus, a need exists for a way to use an antenna-based proximity sensor on a door that has a breakaway feature.

SUMMARY OF THE INVENTION

In some embodiments, a vertically translating door with a breakaway feature includes an antenna disposed along a leading edge of the door. A releasable electrical connector between the antenna and a stationary power source allows the door to temporarily break away from its vertical guide tracks in the event of a collision between the door and an obstruction.

In some embodiments, a track follower couples a door panel to two vertical tracks that help guide the vertical movement of the door. A releasable mechanical connector between the door and the track follower enables the door panel to breakaway during a collision. And a signal generator (e.g., an oscillator) associated with an antenna-based proximity sensor is carried by the track follower.

In some embodiments, the releasable electrical connector is incorporated into the releasable mechanical connector.

In some embodiments, the releasable mechanical connector is selectively releasable by use of a magnet.

In some embodiments, the releasable electrical connector is between the antenna and a signal generator that applies a signal on the antenna.

In some embodiments, the releasable electrical connector is between the signal generator and a stationary power source.

In some embodiments, an antenna-based proximity sensor is applied to a breakaway door that has a roll-up door panel.

In some embodiments, an antenna-based proximity sensor is applied to a breakaway door that has a series of pivotally interconnected panels.

In some embodiments, a vertically translating door with an antenna-based proximity sensor includes a signal generator installed at a fixed location.

In some embodiments, a roll-up door with an antenna-based proximity sensor includes wiring with a rotatable feature that allows the wiring to wrap around the same drum that supports the roll-up door.

In some embodiments, the rotatable feature of the wiring is a rotatable electrical connector.

In some embodiments, the rotatable feature of the wiring is provided by a wire being able to twist about itself.

In some embodiments, wiring between the antenna and the power source extends through the drum that supports a roll-up door, whereby the wires can accommodate twisting about themselves.

DESCRIPTION OF THE PREFERRED EMBODIMENT

Figure 1:
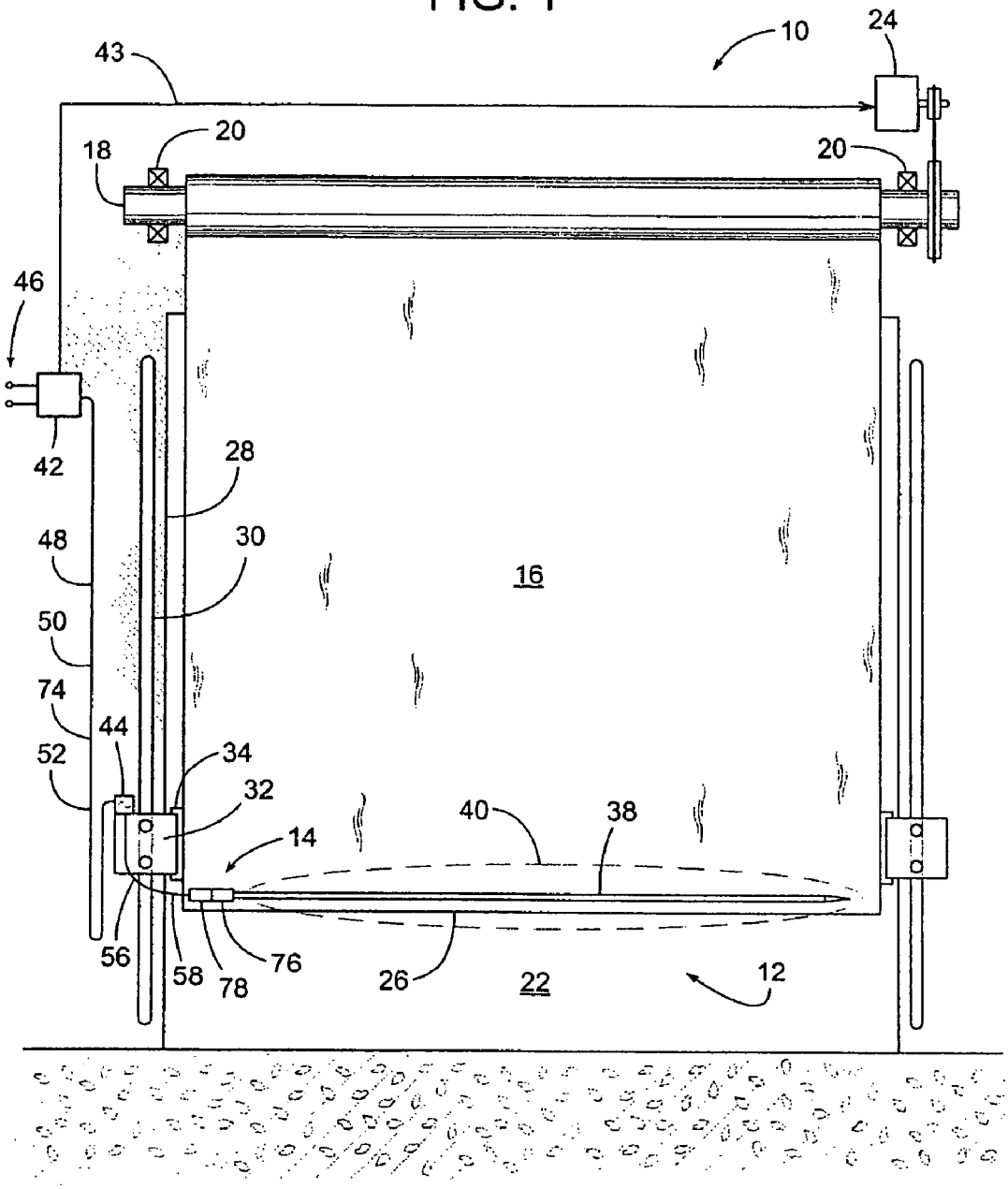
FIG. 1 is a front view of a partially opened translating door panel that includes an antenna-based proximity sensor and a breakaway feature for the panel.
Figure 2:
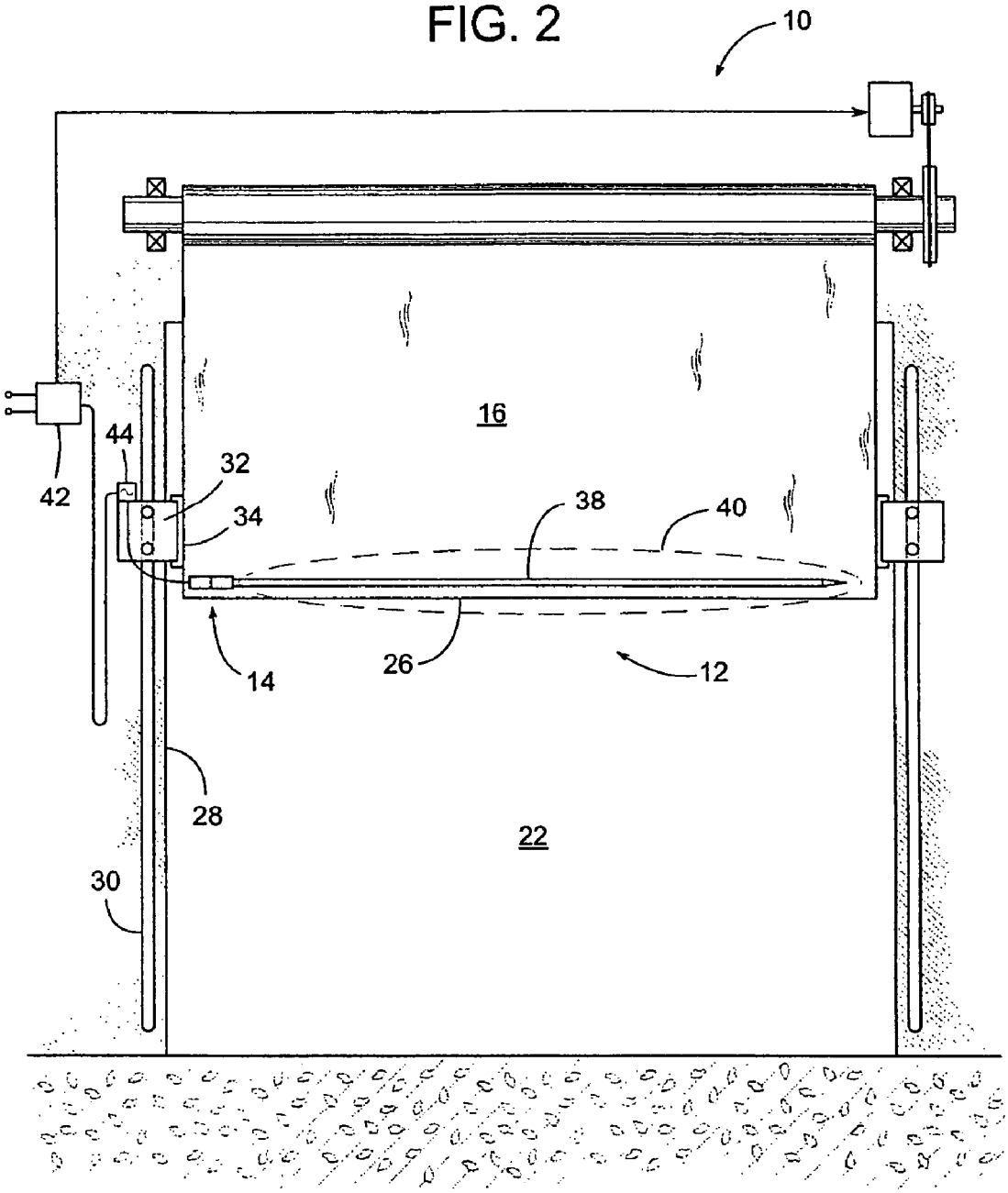
FIG. 2 is a front view of the same door as in FIG. 1 but showing the door panel opened further.
Figure 3:
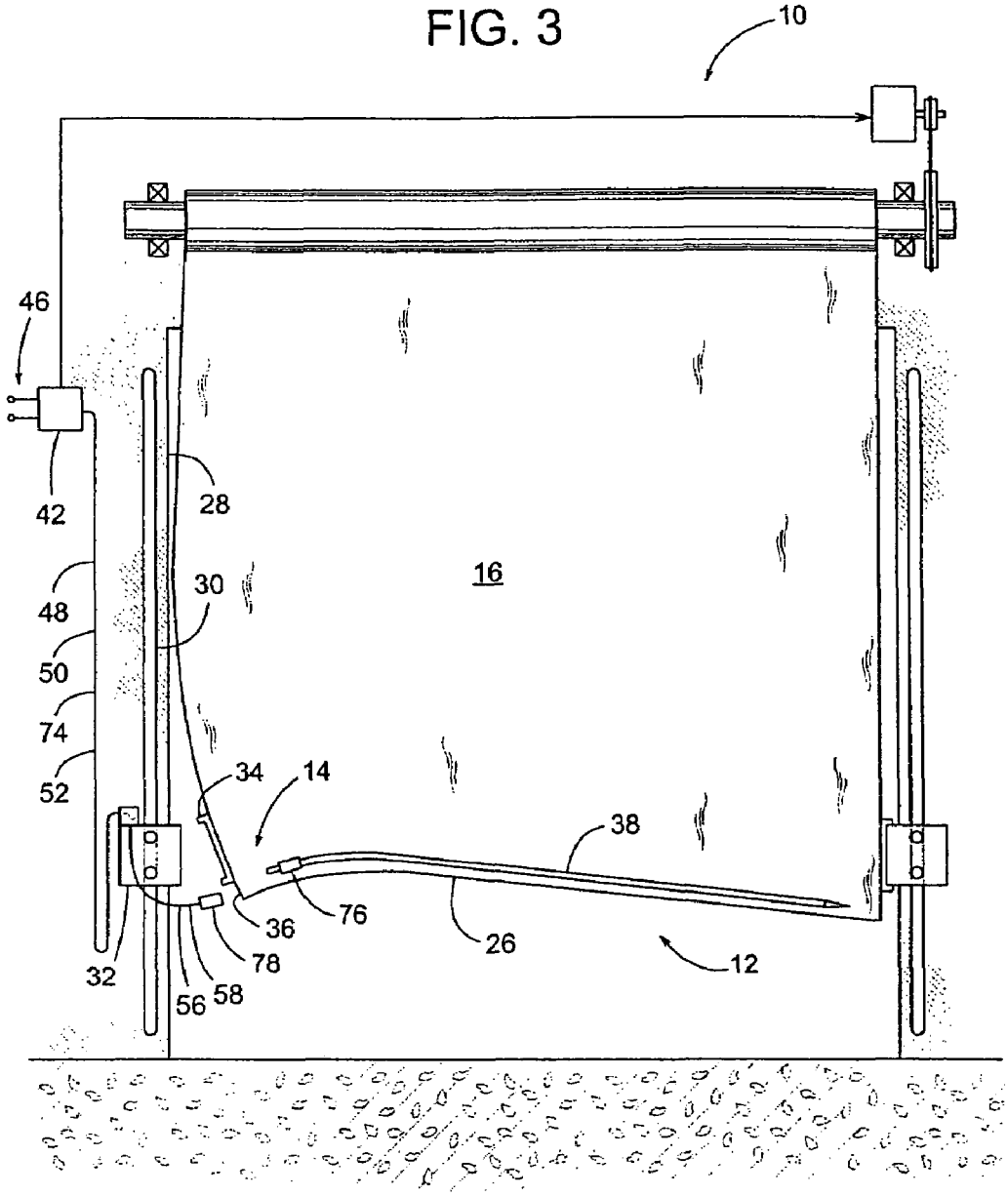
FIG. 3 is a front view of the same door as in FIG. 1 but showing a lower portion of the door panel separated from the doorframe.

A door system 10, shown in FIGS. 1–3, includes an antenna-based proximity sensor 12 having a releasable electrical connector 14 that enables sensor 12 to function with a breakaway feature of the door. FIG. 1 shows door system 10 with its door panel 16 in a nearly closed position, FIG. 2 shows door panel 16 at a more open position, and FIG. 3 shows door panel 16 having been released by the breakaway feature of the door.

In some embodiments, door panel 16 is made of a pliable curtain that wraps about a rotatable drum 18, which in turn is supported by a set of bearings 20. To open and close the door relative to a doorway 22, a drive unit 24 rotates drum 18 in either direction. The drum's direction of rotation determines whether drum 18 takes up or pays out panel 16.

To guide a leading edge 26 of panel 16 along a generally vertical path, door system 10 includes doorframe 28 with a track 30. Track 30 and doorframe 28 may be separate parts, or the two may be a single part with track 30 being an integral feature of doorframe 28. A track follower 32, which is confined to travel along track 30, couples panel 16 to doorframe 28. Doorframe 28, track 30, and track follower 32 are schematically illustrated to represent all types of doorframes, tracks, and track followers. Examples of track 28 include, but are not limited to, a channel, slot, rail, etc. Examples of track follower 32 include, but are not limited to, a trolley, sliding block, linear bearing, etc. A few detailed examples of track follower 32 can be found in U.S. Pat. Nos. 4,887,659; 6,098,695; and 6,352,097 which are specifically incorporated by reference herein.

To avoid impact-related damage to door panel 16, doorframe 28, track 30, or track follower 32, the breakaway feature of door system 10 is provided by a releasable mechanical connector 34 that releasably connects door panel 16 to track follower 32. If door panel 16 is subjected to a predetermined external force, due to panel 16 closing on an obstruction or something striking the door, connector 34 reacts by releasing panel 16 (i.e., releasing at least one end 36 of the door panel's leading edge 26) from track 30 or doorframe 28. After connector 34 releases panel 16, connector 34 and panel 16 can be readily returned to their normal operating conditions. Connector 34 is schematically illustrated to represent any mechanism that enables a door panel to returnably release from its track or doorframe. A few examples of releasable mechanical connector 34 are disclosed in U.S. Pat. Nos. 6,148,897; 6,321,822; 5,957,187; 5,887,385; 5,638,883; 5,620,039; 5,271,448; and 5,025,847 which are specifically incorporated by reference herein. In some embodiments, connector 34 and track follower 32 are held together by a magnetic force of a predetermined magnitude. The door panel's leading edge 26 can be rigid or flexible, and depending on the type of door, the door panel itself can be flexible or rigid.

To help avoid an impact between a closing door panel 16 and a nearby body or object, proximity sensor 12 includes an antenna 38 disposed along leading edge 26 of panel 16. When a nearby body or object disturbs an electromagnetic field 40 around antenna 38, a controller 42 reacts by energizing an alarm and/or affecting the operation of door system 10. In some cases, for instance, an output 43 from controller 42 may cause drive unit 24 to stop or reverse the movement of door panel 16.

Figure 4:
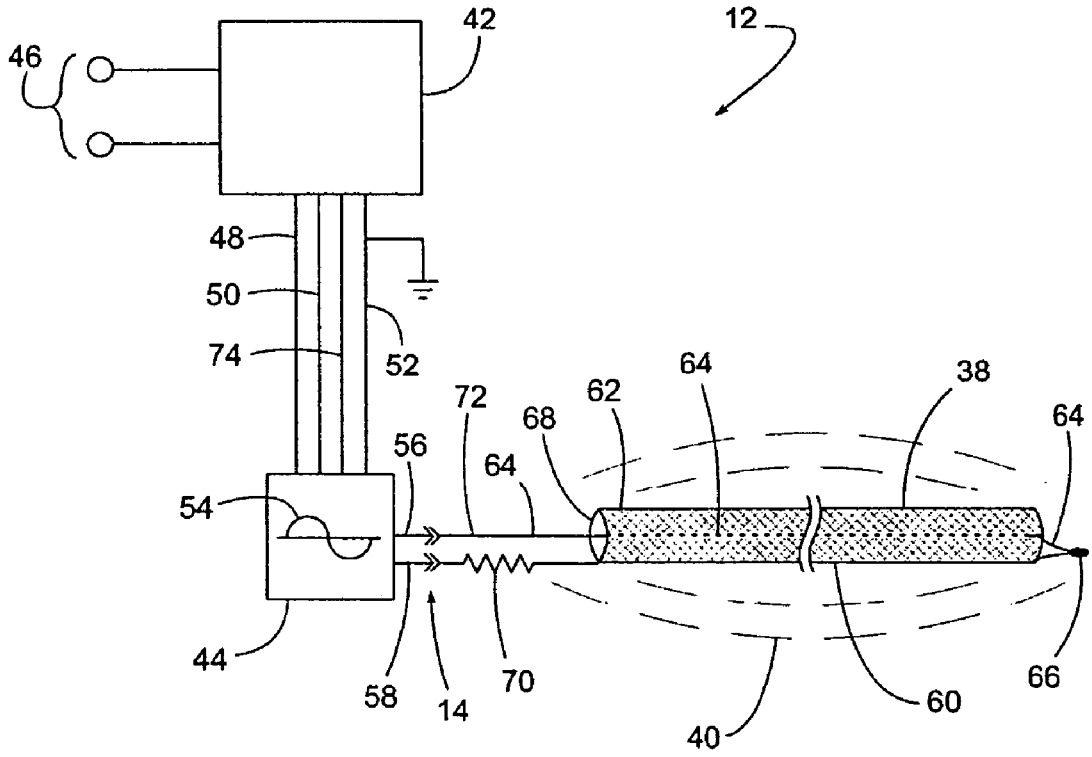
FIG. 4 is a schematic diagram of an antenna-based proximity sensor.

The operation of antenna-based proximity sensor 12 can be understood with reference to FIG. 4 and/or with reference to U.S. Pat. No. 5,337,039, which is specifically incorporated by reference herein. In FIG. 4, antenna-based proximity sensor 12 is shown to comprise controller 42, a signal generator 44 (e.g., an oscillator), and antenna 38. Controller 42, which may be powered by a conventional power source 46 (e.g., 120 VAC), provides electrical power to signal generator 44 via electrical lines 48 and 50. A third line 52 between controller 42 and signal generator 44 provides a ground connection. In a currently preferred embodiment, signal generator 44 functions as a conventional oscillator that provides antenna 38 with a signal 54 that creates the electromagnetic field 40 around antenna 38. Releasable electrical connector 14 and lines 56 and 58 convey signal 54 to antenna 38. The actual voltage, power and frequency of signal 54 may vary; however, in some cases signal 54 is about 9-volts peak-peak at a nominal frequency of about one-megahertz.

Antenna 38 may comprise a coaxial cable 60 whose conductive sheath 62 and central wire 64 are soldered or otherwise connected to each other at an outboard end 66 of antenna 38. An inboard end 68 of sheath 62 is wired to signal generator 44 via a 47 k ohm resistor 70, and line 72 connects an inboard end of wire 64 to signal generator 44.

Under normal conditions where field 40 is generally undisturbed, signal generator 44 oscillates at its nominal frequency (e.g., one-megahertz). The frequency (or change thereof) of this signal is communicated back to controller 42 via line 74. When a body or object disturbs field 40 by altering the capacitive coupling between antenna 38 and ground, signal generator 44 tends to oscillate at some lower frequency below the nominal frequency of one-megahertz. This drop in frequency is what identifies that a nearby obstruction may be present. The actual magnitude of the delta-frequency depends on the type of disturbance and the geometry of the antenna. The drop in frequency is detected by comparing the oscillating frequency of signal generator 44 to a conventional phase lock loop circuit that may be incorporated in signal generator 44 or controller 42.

When door panel 16 breaks away from doorframe 28, damage to the antenna-based proximity sensor 12 can be avoided by installing releasable electrical connector 14 somewhere between power source 46 and antenna 38. Although the actual structure and location of connector 14 may vary, in some cases, connector 14 comprises a conventional plug 76 and socket 78 installed between signal generator 44 and antenna 38. Depending on the particulars of the connection between generator 44 and antenna 38, connector 14 may or may not need to be a coaxial connector. When door panel 16 releases or breaks away from doorframe 28, plug 76 simply pulls apart from socket 78 as shown in FIG. 3. Plug 76 separating from socket 78 interrupts the electrical path between power supply 46 and antenna 38. Afterwards, connectors 14 and 34 can each be returned to their normally attached conditions to re-establish the electrical path between controller 42 and antenna 38 and to restore door system 10 back to normal operation.

Figure 5:
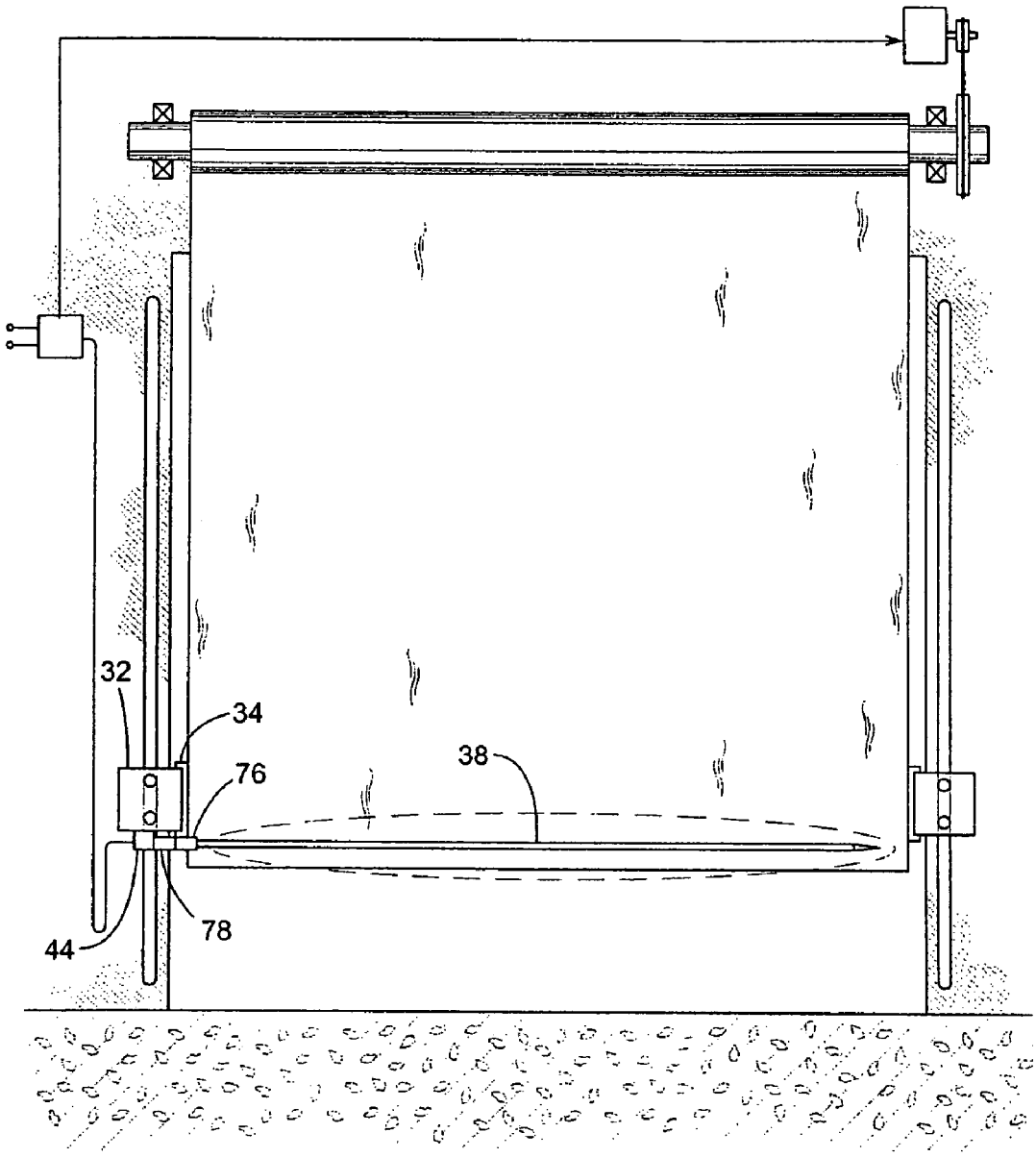
FIG. 5 is a front view similar to FIG. 1 but showing another embodiment of a translating door system.
Figure 6:
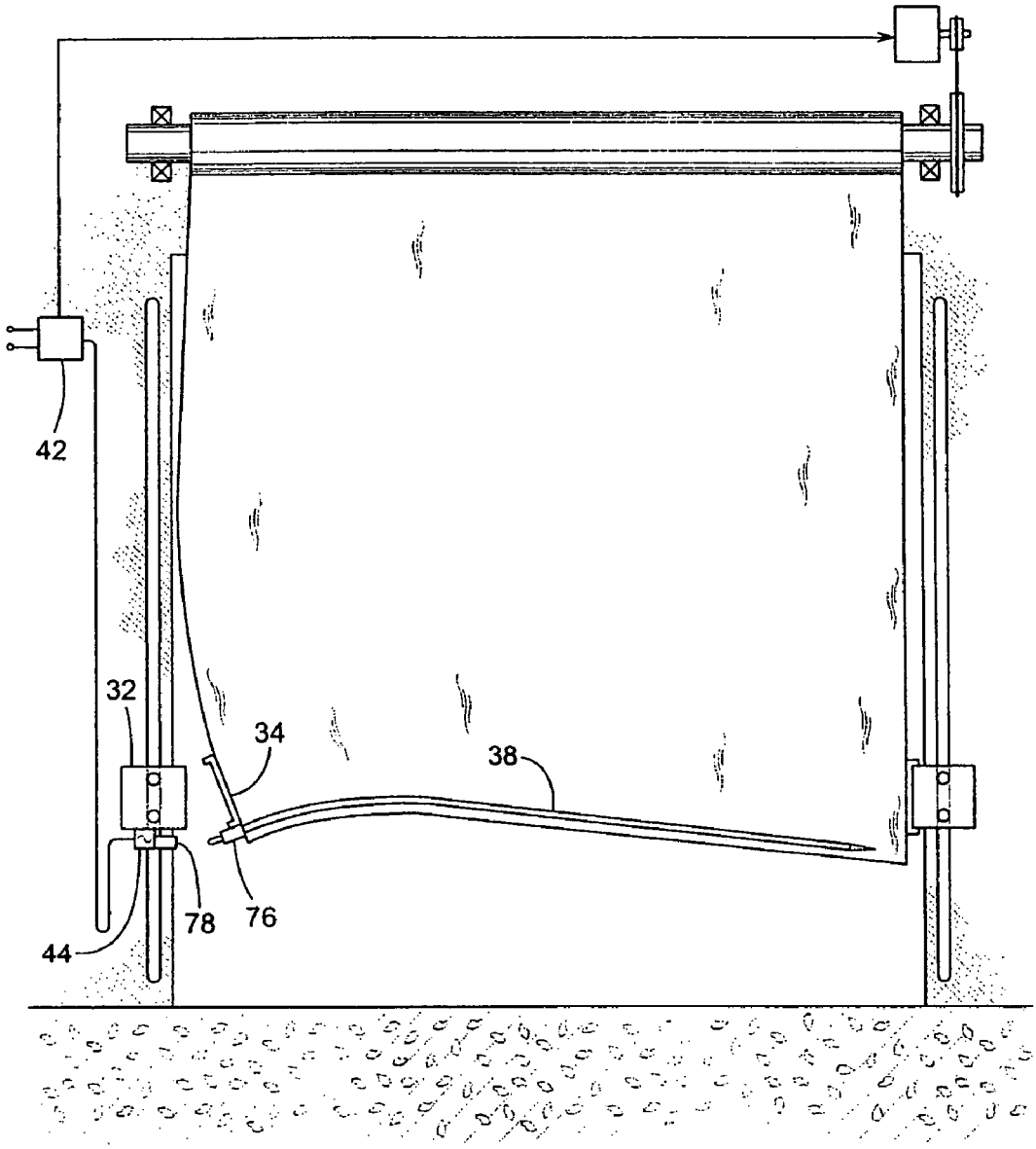
FIG. 6 is a front view of the same door as in FIG. 5 but showing a lower portion of the door panel separated from the doorframe.

To simplify the reattachment of connectors 14 and 34, the structures of the two connectors 14 and 34 can be operatively connected or combined to operate in unison, whereby connectors 14 and 34 break away and reconnect as a unit rather than as separate mechanical and electrical connectors. In FIGS. 5 and 6, for example, socket 78 is fixed relative to track follower 32 and plug 76 is fixed relative to mechanical connector 34. Signal generator 44 can be installed adjacent to socket 78 to minimize or eliminate the wiring between generator 44 and socket 78.

Figure 7:
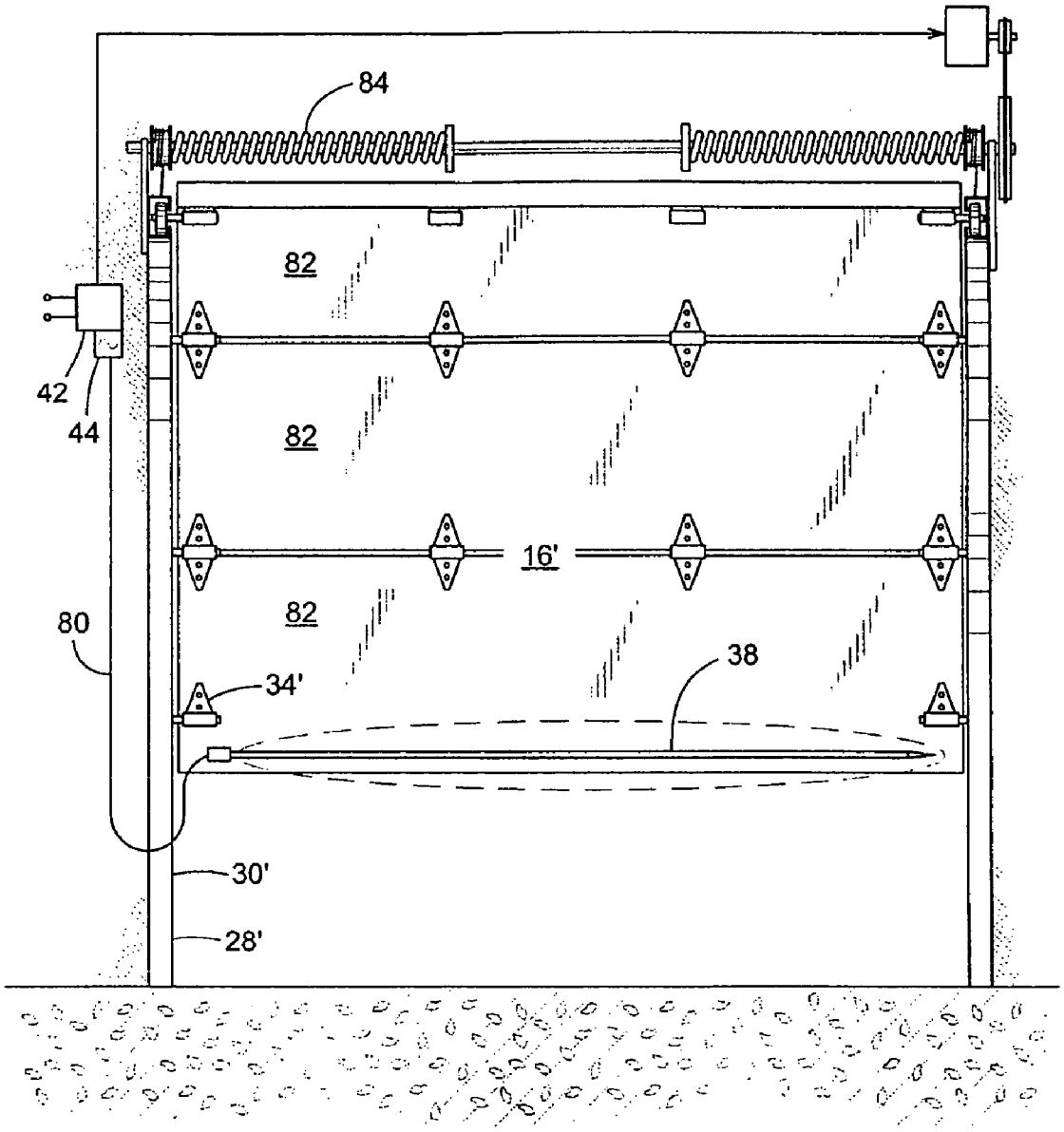
FIG. 7 is a front view similar to FIG. 1 but showing a door system having pivotally interconnected panel members.

Signal generator 44 can also be mounted at a stationary location as shown in FIG. 7. In this case, a long flexible wire 80 (e.g., a coiled electrical cable) connects signal generator 44 to antenna 38. Wire 80 is of sufficient length and flexibility to allow a door panel 16' to break away from a track 30' of a doorframe 28'. Although, in this example, door panel 16' comprises a series of pivotally interconnected rigid or semi-rigid panel members 82, a pliable door panel or curtain is also well within the scope of the invention. When heavier rigid panels are used, a spring 84 or counterweight can be used to help offset the weight of the door panel members. A releasable mechanical connector 34' allows door panel 16' to break away from track 30'.

Figure 8:
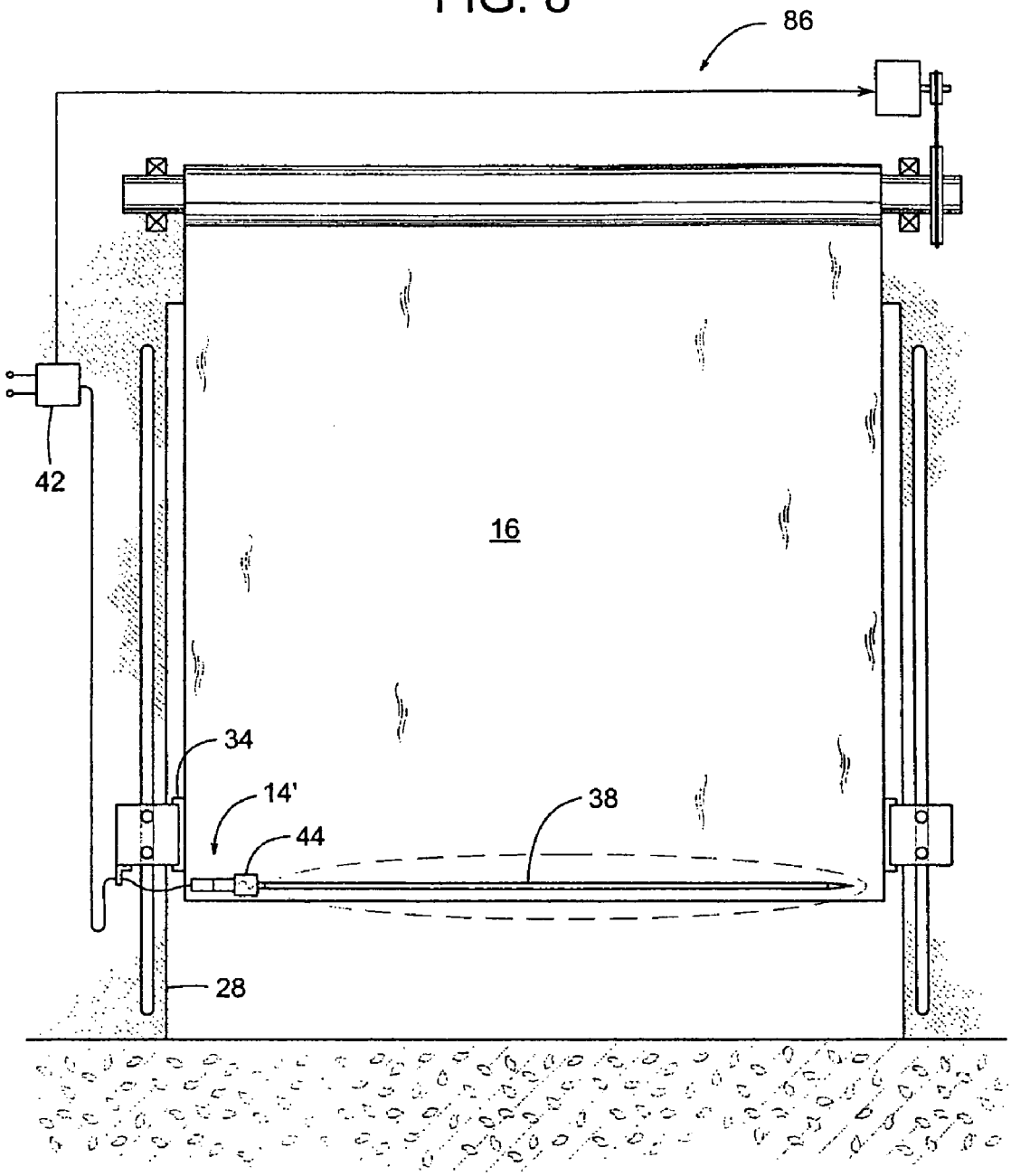
FIG. 8 is a front view similar to FIG. 1 but showing another embodiment of a translating door system.
Figure 9:
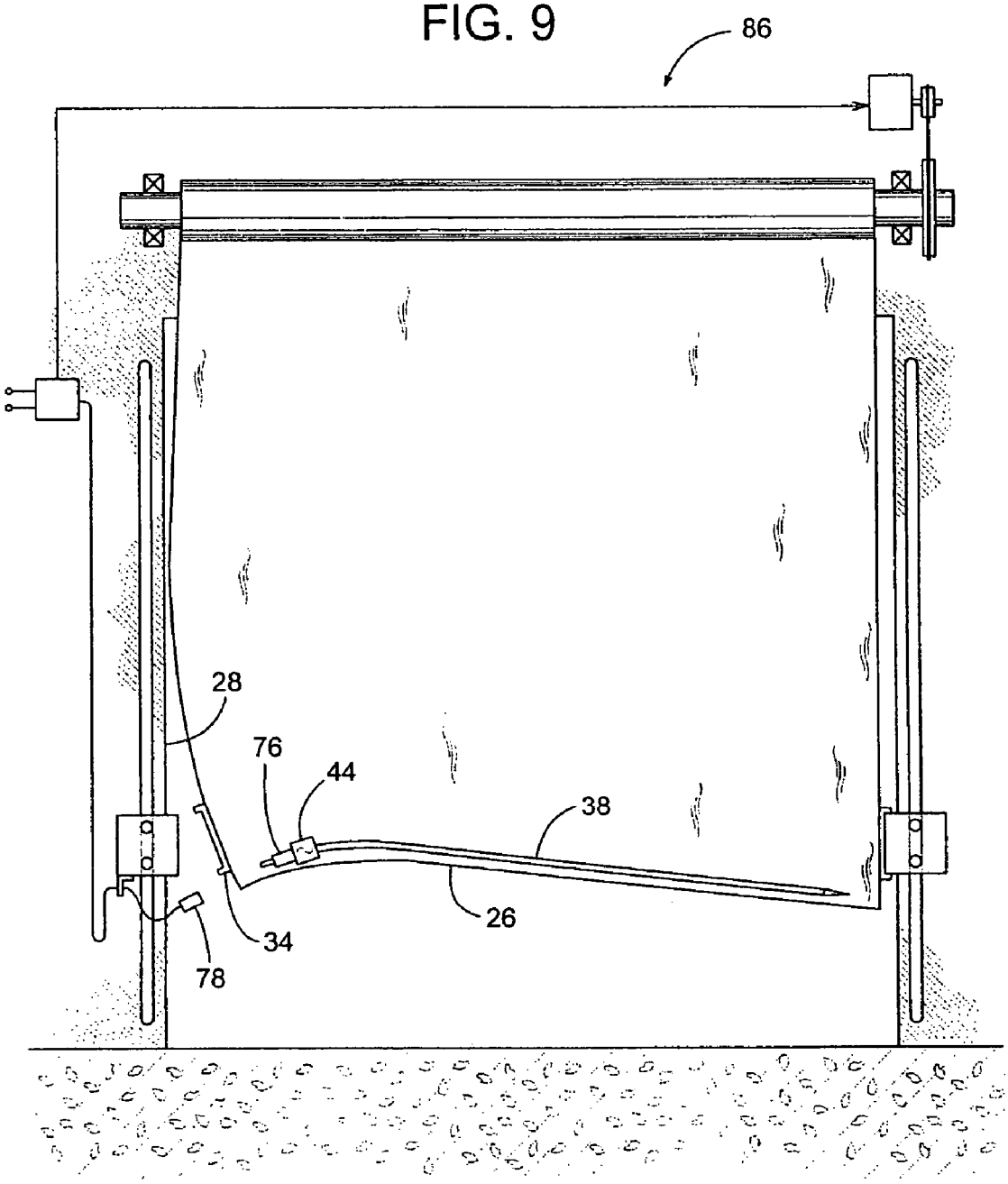
FIG. 9 is a front view of the same door as in FIG. 8 but showing a lower portion of the door panel separated from the doorframe.

In another embodiment, shown in FIGS. 8 and 9, a door system 86 has signal generator 44 attached to door panel 16, and releasable electrical connector 14' is interposed between generator 44 and controller 42. In this case, connector 14' has multiple conductors for carrying both the signal voltage on line 74 and the generator's supply voltage. FIG. 8 shows door system 86 in its normal operating condition, and FIG. 9 shows one end of the door panel's leading edge 26 separated from doorframe 28. The separation and reconnection of connectors 14 and 34 is similar to that of door system 10.

Figure 10:
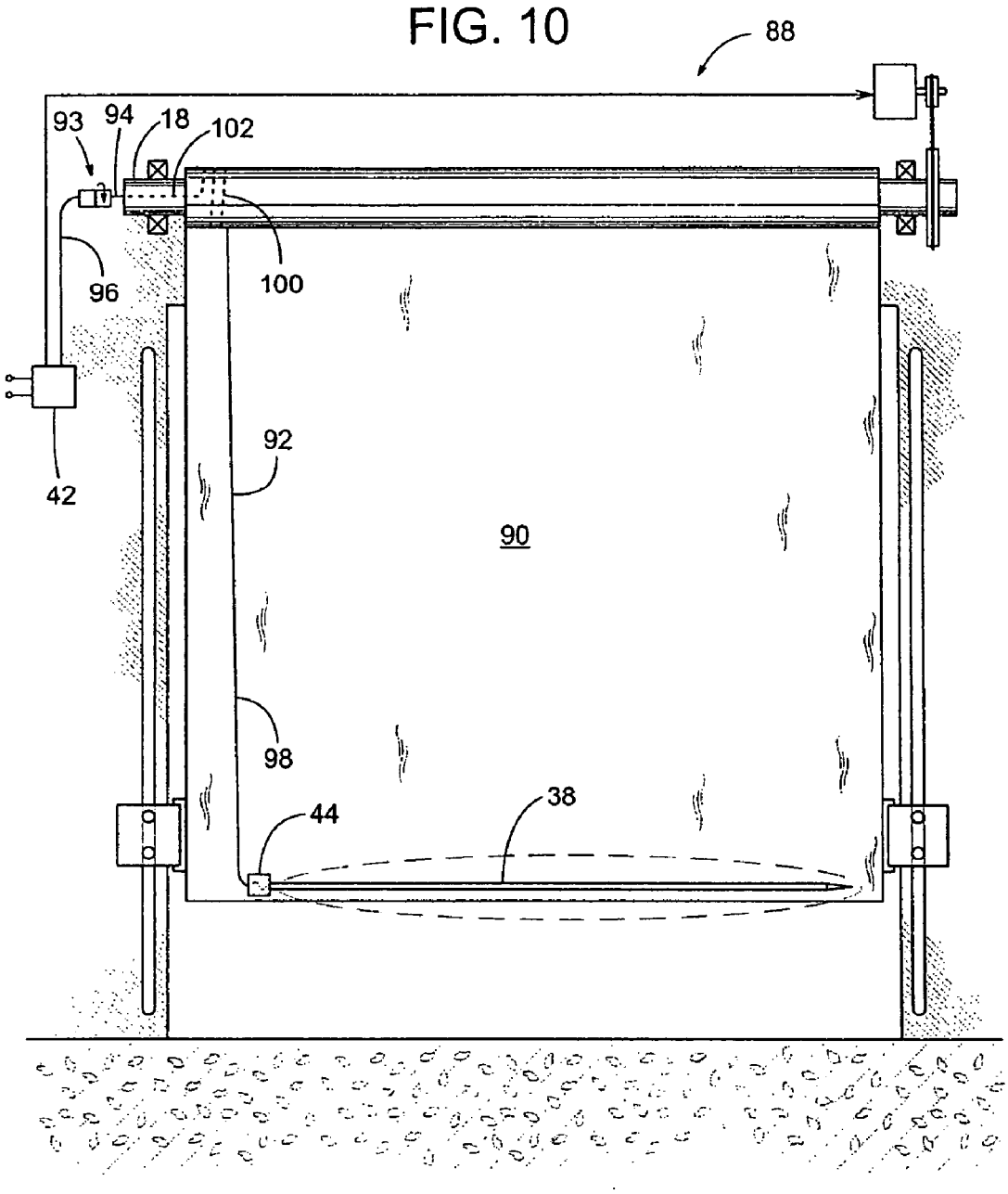
FIG. 10 is a front view similar to FIG. 1 but showing another embodiment of a translating door system.

In FIG. 10, a door system 88 has generator 44 attached to a door panel 90, and a wire 92 with a rotatable feature connects generator 44 to controller 42. In this case, the rotatable feature is a rotatable electrical connector 93 that allows one portion 94 of wire 92 to rotate relative to a stationary portion 96 of wire 92. Such rotatable electrical connectors are well known to those skilled in the art. Portion 98 of wire 92 lies along the face of panel 90 and becomes wrapped about drum 18 as the door opens. Dashed lines 100 show the wrapped portion of wire 92. At some point, portion 100 of wire 98 feeds through a radial hole in drum 18, and a section of wire 102 runs through the interior of drum 18 between connector 93 and the radial hole in drum 18. With this design, a breakaway electrical connector is not needed.

Figure 11:
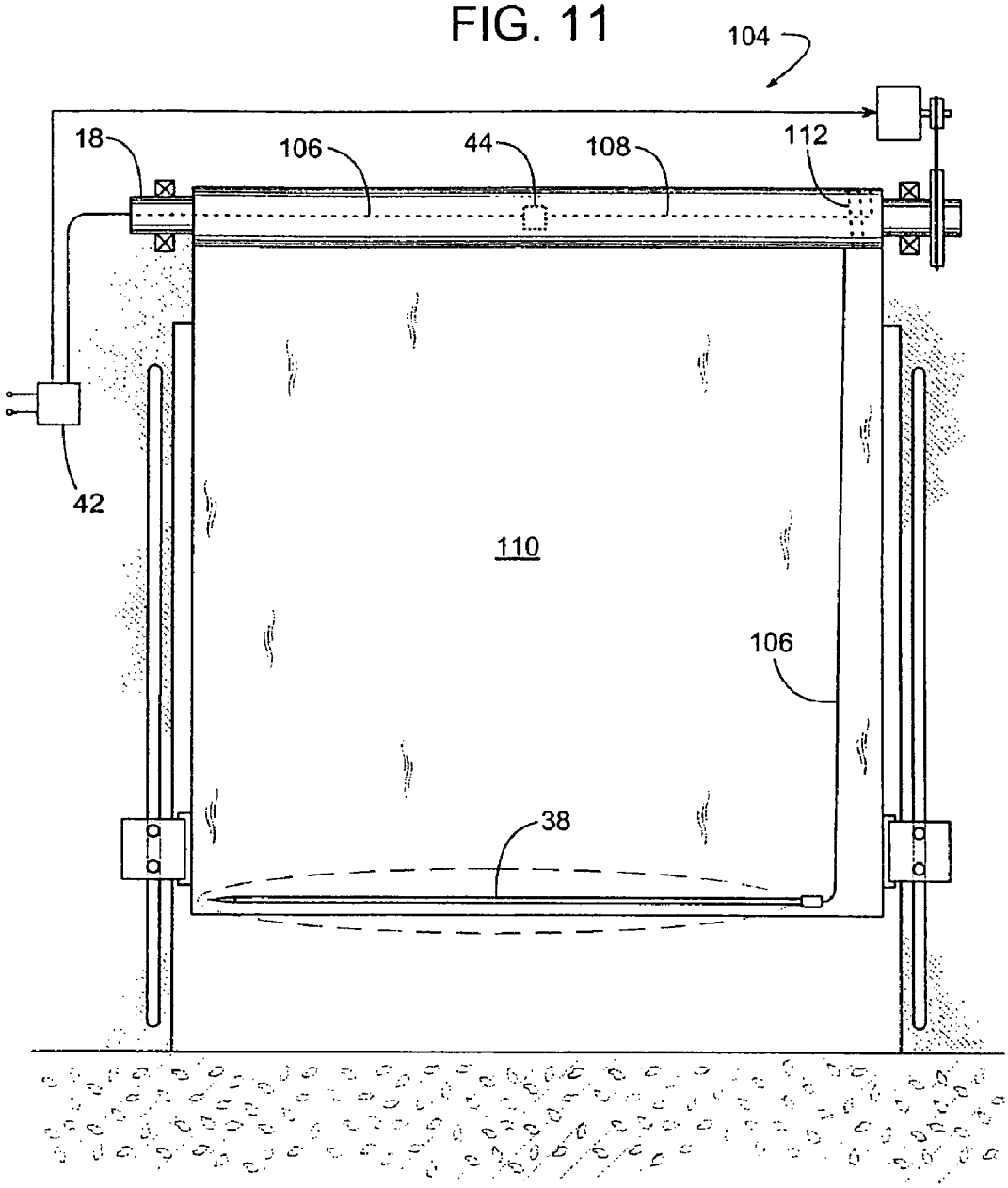
FIG. 11 is a front view similar to FIG. 1 but showing yet another embodiment of a translating door system.

FIG. 11 shows another door system 104 that does not need a breakaway electrical connector. Door system 104 is similar to door system 88; however, the rotatable feature of a wire 106 between controller 42 and antenna 38 is provided by one or more wire sections 106 and/or 108 being able to twist about itself within the hollow interior of drum 18. In this example, wire 106 lies along a face of a door panel 110 with a portion 112 of wire 106 being wrapped about drum 18. Wire 106 extends through a radial hole in drum 18, and wire section 108 extends from that hole to signal generator 44. Wire section 106 connects generator 44 to controller 42. Although generator 44 is shown near the center of drum 18, generator 44 could be at either end of drum 18 or even mounted adjacent to controller 42 or adjacent to antenna 38. Placing generator 44 adjacent to controller 42 could eliminate or minimize the length of wire section 106.

Although the invention is described with respect to a preferred embodiment, modifications thereto will be apparent to those skilled in the art. Therefore, the scope of the invention is to be determined by reference to the claims, which follow.

We claim:

1. A sensor system for use with a door associated with a power source, wherein the door has a leading edge that is vertically movable in translation along a doorframe and the leading edge has at least one end that can release from the doorframe for an applied force above a certain magnitude, the sensor system comprising:

an antenna mountable adjacent to the leading edge such that it is vertically movable in translation therewith;

a signal generator electrically coupled to the antenna, whereby the signal generator creates an electromagnetic field adjacent to the antenna; and a releasable electric connector selectively providing and interrupting an electrical path between the antenna and the power source, wherein the releasable electrical connector interrupts the electrical path in reaction to the one end of the leading edge releasing from the doorframe.

2. A door system associated with a power source, comprising:

a doorframe adapted to be disposed about an opening in wall;

a door panel having a leading edge that is vertically movable in translation along the doorframe, wherein the leading edge has at least one end that can release from the doorframe for an applied force above a certain magnitude, thereby defining a distance between the door panel and the doorframe;

an antenna disposed adjacent to the leading edge and being vertically movable in translation therewith;

a signal generator electrically coupled to the antenna, whereby the signal generator creates an electromagnetic field adjacent to the antenna; and an electrical line that provides an electrical path between the antenna and the power source, wherein the electrical line is adapted to take at least a position in which it does not span the distance between the door panel and the doorframe.

* * * * *